United States Patent [19]

Bärschneider

[11] Patent Number: 4,582,019

[45] Date of Patent: Apr. 15, 1986

[54] ADHESIVE APPLICATOR FOR WALLPAPER

[76] Inventor: Lüdwig Bärschneider, Ebersbacherstr. 36, D-8750 Aschaffenburg, Fed. Rep. of Germany

[21] Appl. No.: 628,734

[22] Filed: Jul. 9, 1984

Related U.S. Application Data

[63] Continuation-in-part of Ser: No. 569,765, Jan. 10, 1984, abandoned.

[30] Foreign Application Priority Data

Jan. 26, 1983 [DE] Fed. Rep. of Germany ..... 3302463

[51] Int. Cl.[4] ..... B05C 1/12

[52] U.S. Cl. ..... 118/246; 118/235; 118/249; 118/261; 118/DIG. 17

[58] Field of Search ..... 118/246, 247, 249, DIG. 17, 118/235, 210, 261

[56] References Cited

U.S. PATENT DOCUMENTS

| | | | |
|---|---|---|---|
| 2,260,185 | 10/1941 | McDevitt | 118/235 X |
| 2,440,481 | 4/1948 | Lowery | 118/DIG. 17 |
| 2,915,038 | 12/1959 | Wallenberg | 118/249 |

*Primary Examiner*—John P. McIntosh

*Attorney, Agent, or Firm*—Marmorek, Guttman & Rubenstein

[57] ABSTRACT

An apparatus for applying glue to a wallpaper which is passed therethrough along a drive direction includes a frame which is adapted to hold glue, a glue application roller mounted on the frame, a rerouting roller in parallel with, and downstream of the application roller, as seen along the drive direction, and adapted to be in operative engagement with the glue application roller through the wallpaper, and a drive motor in direct driving connection with the rerouting roller.

12 Claims, 8 Drawing Figures

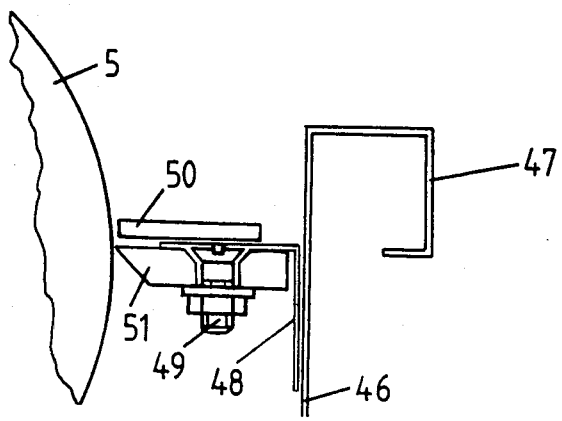
FIG. 6
FIG. 7
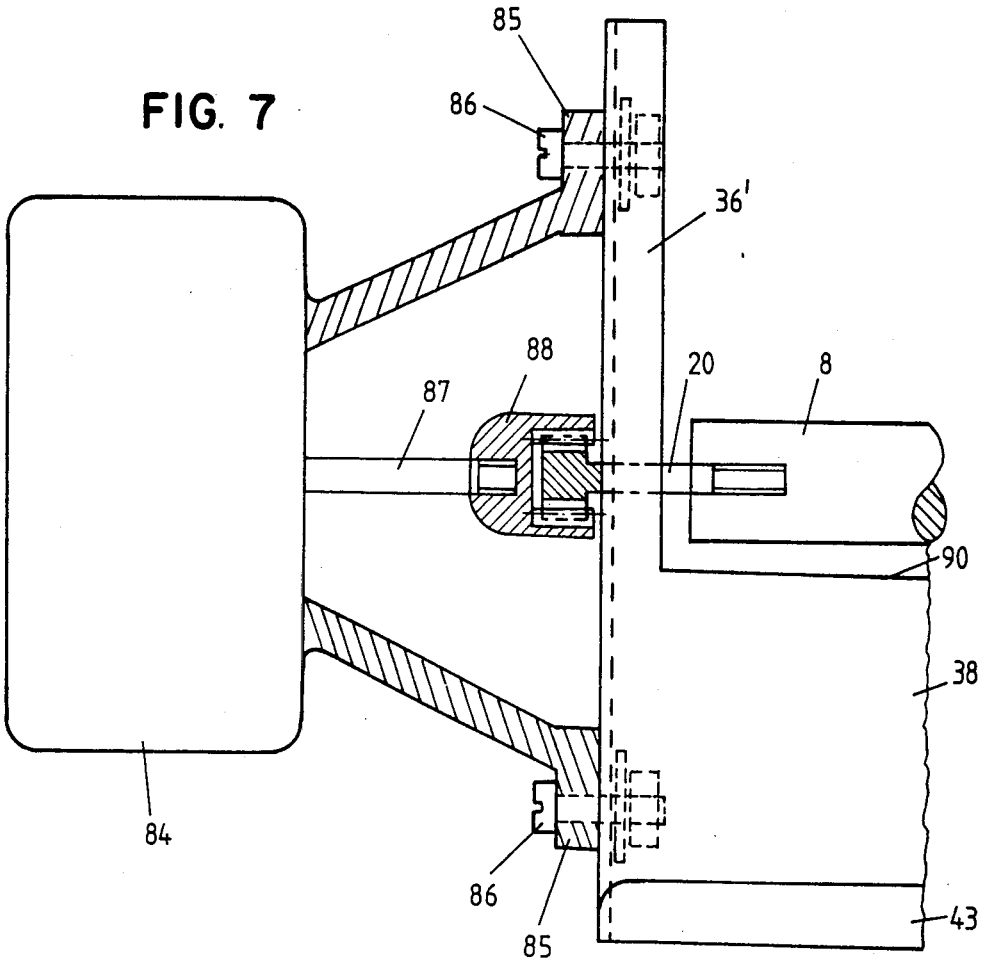

ADHESIVE APPLICATOR FOR WALLPAPER

REFERENCES TO COPENDING APPLICATIONS

This application is a continuation-in-part application of application Ser. No. 569,765 filed on Jan. 10, 1984, now abadoned, for Adhesive Applicator for Wallpaper.

BACKGROUND OF THE INVENTION

The invention relates to an apparatus for glueing on wallpaper, which includes an application roller, a rerouting roller disposed parallel thereto, and a drive motor.

Devices known from the prior art have been provided with an application roller, which is immersed into a glue to be applied to a sheet of wallpaper, and a rerouting roller disposed in parallel with the application roller. In most prior art devices the wallpaper is drawn manually through the device. This requires a considerable force, particularly in the case of wide wallpaper, and wallpaper made of strong material. For this reason for some time devices for glueing on wallpaper using a drive motor have been known, in which the drive motor drives the application roller. The resulting peripheral force is therefore transmitted through a coating of glue, which adheres to the periphery of the application roller, and which is to be applied to the wallpaper. This carries with it the risk that the sheet of wallpaper is not carried along at the same velocity as the periphery of the application roller, so that as a result thereof the glue accumulates on the inlet side of the sheet of wallpaper, and results in a very non-uniform application. In order to obviate this disadvantage, it is known to additionally drive the rerouting roller also. But as in these known devices the rerouting roller is supported on a cover or hood, which may be swung up, so that the axle of the rerouting roller is spaced away from the axle of the application roller, when the hood is swung open, a complicated drive using toothed wheels is required. The toothed wheels, in turn, are disengaged from one another when the cover is swung open, and are reengaged with one another when the cover is repositioned to the operating position; this, in turn, carries with it the risk that the toothed wheels may be damaged when the cover is lowered.

SUMMARY OF THE INVENTION

It is an object of the invention to devise as simple a drive as possible, which can be manufactured with few constructional elements, and which is not easily subject to any malfunction.

To attain this object, according to the invention, the drive motor acts at least directly only on the rerouting roller. Drive of the rerouting roller is therefore accomplished by the drive acting directly thereonto, and not only through the drive of the application roller, and derived therefrom. By this means any difficulties are avoided which could arise by the drive torque being transmitted from the shaft of the application roller to the rerouting roller. Furthermore an additional substantial advantage arises, in as much as when the sheet of wallpaper is allowed to slacken, namely is not positively pulled, it fails to firmly abut the periphery of the rerouting roller, and consequently is not transported therewith. But transport is immediately accomplished, if the sheet of wallpaper is only slightly pulled, so that it abuts the circumference of the rerouting roller, and is taken along therewith by adhesion due to friction. By this means the start and the end of transportation, and primarily interruption thereof, can be accomplished much more quickly and simply than if the drive motor would have to be switched in and out every time. In the system according to the invention, the drive motor can rather be run continuously, and transport is accomplished by a simple and easy pulling of the sheet of the wallpaper. The diameter of the rerouting roller is advantageously about 25 mm, and the diameter of the application roller is about 3 to 4 times the diameter of the rerouting roller of known prior art devices. But even other diameters or diameter ratios can be shown to be advantageous.

In devices in which the rerouting roller is supported on a covering hood which may be swung up, in an advantageous implementation of the invention the drive motor is supported on a construction part or support member, which, in turn is pivotable about a pivot axle disposed coaxially with respect to the pivot axle of the cover; thus the drive motor is in turn pivotable about the pivot axle of the cover, or about a pivot axle disposed coaxially with the pivot axle of the cover. Here the drive motor can either be supported directly on the cover, or can be supported thereon indirectly, by the drive motor being supported on a construction part or support member, which in turn is secured to the cover.

The shaft of the drive motor can be arranged to be coaxial with the axle of the rerouting roller, but can also be arranged at right angles thereto, and drive the rerouting axle through a bevel gearing, which may simultaneously serve to reduce the number of revolutions.

If it is required or desirable that the application roller be also driven, then an advantageous further development permits this feature due to the fact that a ring made of rubber or polyurethane is mounted on the rerouting roller, or is stretched or clamped thereonto. The ring then abuts the application roller with its periphery at a suitable force and drives it, when the cover is lowered.

So as to obtain an effective connection between the drive motor and the rerouting roller for the purpose of transmitting a torque therebetween, a bore of the rerouting roller may be provided with a polygonal inner periphery, for example of a four-sided shape, or of a hexagonal shape, or a wedge-type shape, and the shaft of the drive motor may be provided with a correspondingly mating outer periphery. Alternately, the shaft of the drive motor may be connected to the rerouting roller through an intermediate member or coupling member formed with coaxial recesses on respective lateral ends thereof, while the end of the shaft of the drive moter, and the end of a shaft of the rerouting roller may be formed with a correspondingly mating coaxial recess formed to have an appropriate matching polygonal shape.

So as to avoid any risks which may arise in the case of a driven rerouting roller, and where a sheet of wallpaper is not guided therealong, but a finger of an operator may become lodged in a gap between the rerouting roller and the cover, in a further advantageous development of the invention the intermediate member may be constructed so as to either break upon a torque exceeding a predetermined limit being applied thereto, or be implemented as a coupling member, which limits such a torque to a predetermined value. Alternately the torque of the drive motor may be appropriately arranged so that the motor no longer rotates in such a manner so as to also exert a relatively large torque while rotating. For example the drive motor, which is an electric motor, may be implemented as a synchronous motor, which falls out of synchronism when a load is applied.

It is particularly advantageous if the support of the rerouting roller is so implemented that if a finger is lodged in the above-named gap, a lateral or transverse force is exerted onto the rerouting roller, so that it can yield in its support. When the sheet of wallpaper is pulled, the support of the rerouting roller need only receive forces which are directed approximately in a tangential direction towards the upper side of the application roller. If, however, a finger happens to be lodged in the above-named gap, forces must be received which are directly opposite thereto. A suitable partial solution of this object, namely to reduce any risk to the operator, is attained if the support pin of the rerouting roller is supported in an elastically or plastically deformable sleeve, for example in a nylon sleeve, that sleeve in turn being supported in an exactly fitting bore, but wherein the bore is formed with a slit-like extension, which extends approximately tangentially to the upper edge of the application roller and away therefrom, and which is somewhat narrower (for example by half a millimeter) than the support bore. Then the support sleeve may be pressed back into the slit, when the above-named transverse forces to be limited appear, so that the rerouting roller may in turn yield.

BRIEF DESCRIPTION OF THE DRAWINGS

For a fuller understanding of the nature and objects of the invention, reference should be had to the following detailed description, taken in connection with the accompanying drawings, in which:

FIG. 6 is a large scale detail of a strip-off device in cross-section, FIG. 7 is a fragmentary plan view of a third version of the machine, according to the present invention, wherein the motor is mounted directly onto the cover by means of flanged struts.

DESCRIPTION OF THE PREFERRED EMBODIMENTS

Figure 1:
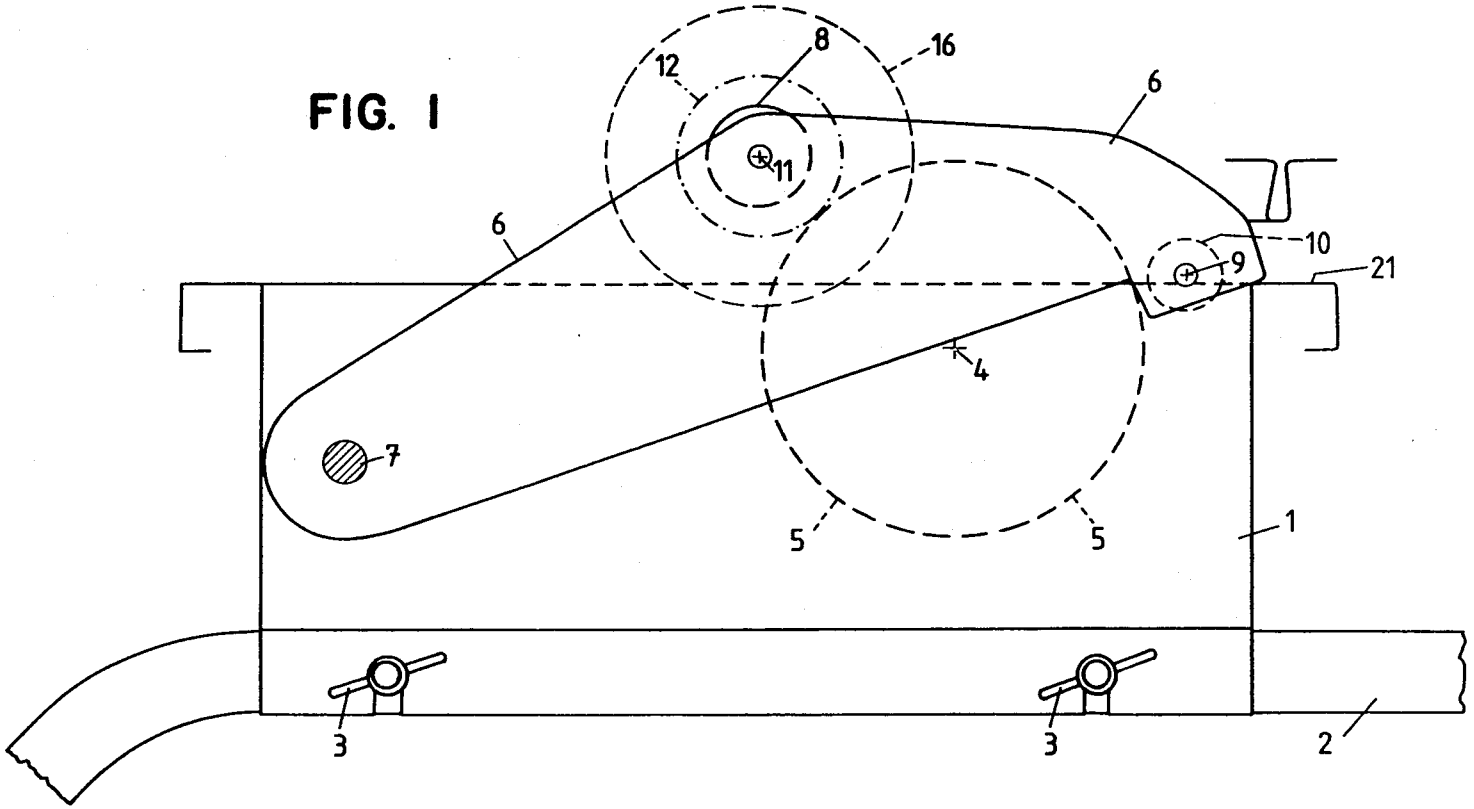
FIG. 1 is an elevation view of the left side of FIG. 2 in the plane I—I according to FIG. 2.
Figure 2:
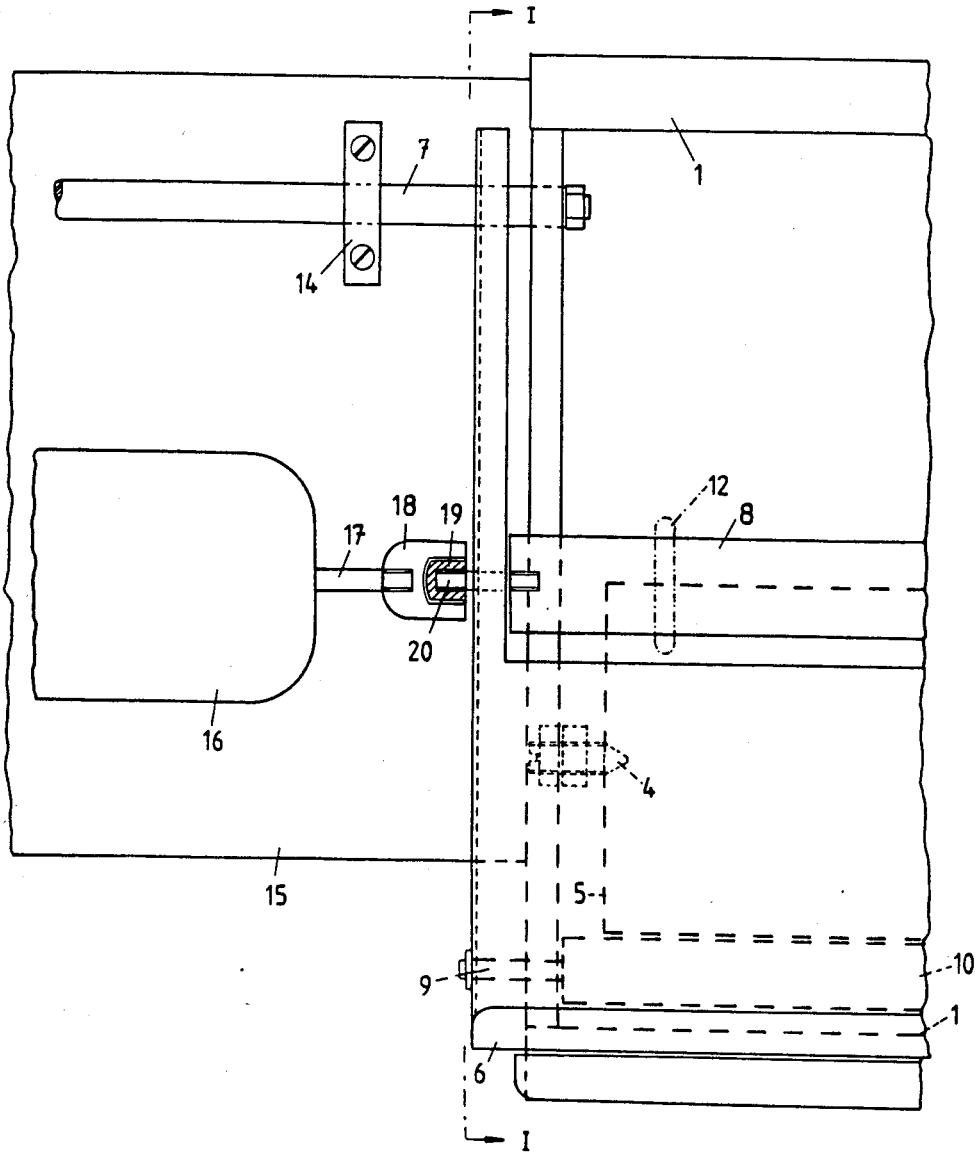
FIG. 2 is a top plan view of the inventive apparatus.

Referring now primarily to FIGS. 1 and 2 of the drawing, a glue container 1 is connected to a stand 2 by means of wing nuts 3. A glue application roller 5 is rotatably supported on an axle 4 disposed in the glue container 1.

A cover 6 is pivotable around an axle 7. A rerouting roller 8 is rotatably supported on the cover 6 around an axle 11 which, in turn, is rigidly supported on the cover 6. Furthermore, on an inlet side, there is supported on the cover 6 a roller 10 about an axle 9 rigidly disposed on the cover; the roller 10, in turn, ensures that the width of wallpaper guided below the roller 10 surrounds the glue application roller 5 at an adequately large angle, before it is fed to the rerouting roller 8, and wherein the sheet of the wallpaper is again drawn off rightwardly as shown in FIG. 1.

A friction wheel 12, which operatively abuts the periphery of the glue application roller 5, and is mountable onto the rerouting roller 8, is shown in dash-dotted lines.

From FIG. 2 it will be recognized that a support plate 15 is supported on the pivot axle 7 of the cover 6 by means of a support bracket 14, the pivot axle 7 being implemented as a rod, a drive motor 16 being secured to the support plate 15. A coupling member 18 is mounted on the shaft 17, the coupling member 18 being connected through a toothed intermediate member 19, which, for example, has a recess formed with a polygonal surface, to a pin 20, which has a peripheral surface correspondingly matched to the shape of the recess of the intermediate member 19. The pin 20 is in turn coupled in a rotation-free manner to the rerouting roller 8.

Operation is as follows: Upon operating the apparatus, first the drive motor 16 is switched on, so that the drive motor 16, and consequently the rerouting roller 8 begin to rotate. Subsequently a sheet of wallpaper is fed from the right-hand side, as seen FIG. 1, through an inlet lip 21 of the glue container 1 below and past the roller 10, and over the application roller 5 below the rerouting roller 8, the sheet being withdrawn therefrom in a rightwardly upward direction. As long as no manual pull is exerted on the sheet of wallpaper, and as long as the sheet of wallpaper abuts only loosely one, or at most two lines of the periphery of the rerouting roller 8, the sheet of wallpaper is not taken along by the rerouting roller 8, namely is not transported therewith. But if a pull is exerted on the sheet of wallpaper, then the wallpaper abuts the periphery of the rerouting roller 8, and is taken along or transported therewith.

The members 1 through 11 and 21 are available also in the case of manually driven devices. A subsequent extension of the pivot axle 7, and subsequent installation or retrofit of the parts 14 through 19, or modification of a manually driven device to a motor-driven device is very easily possible.

Figure 4:
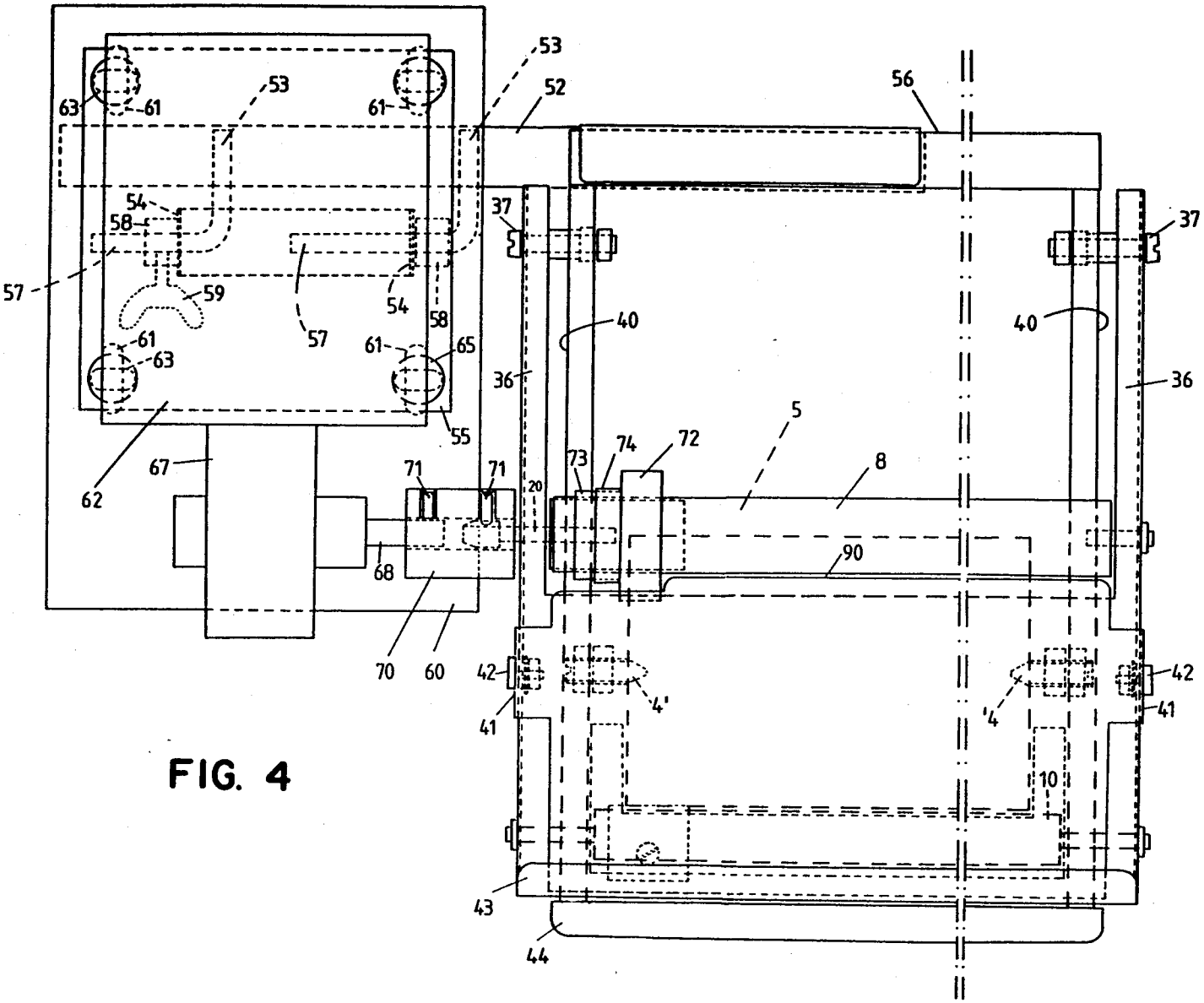
FIG. 4 is a plan view of a second version of the apparatus, according to the present invention, which differs from that shown in FIG. 2 only as it relates to the support for the carrier plate for the motor.

Referring now primarily to FIG. 4, it will be seen that a portion of the width of the container 1 and of the rollers has been cut out from FIG. 4, mainly so that the entire apparatus can be shown more clearly in a single view.

Figure 5:
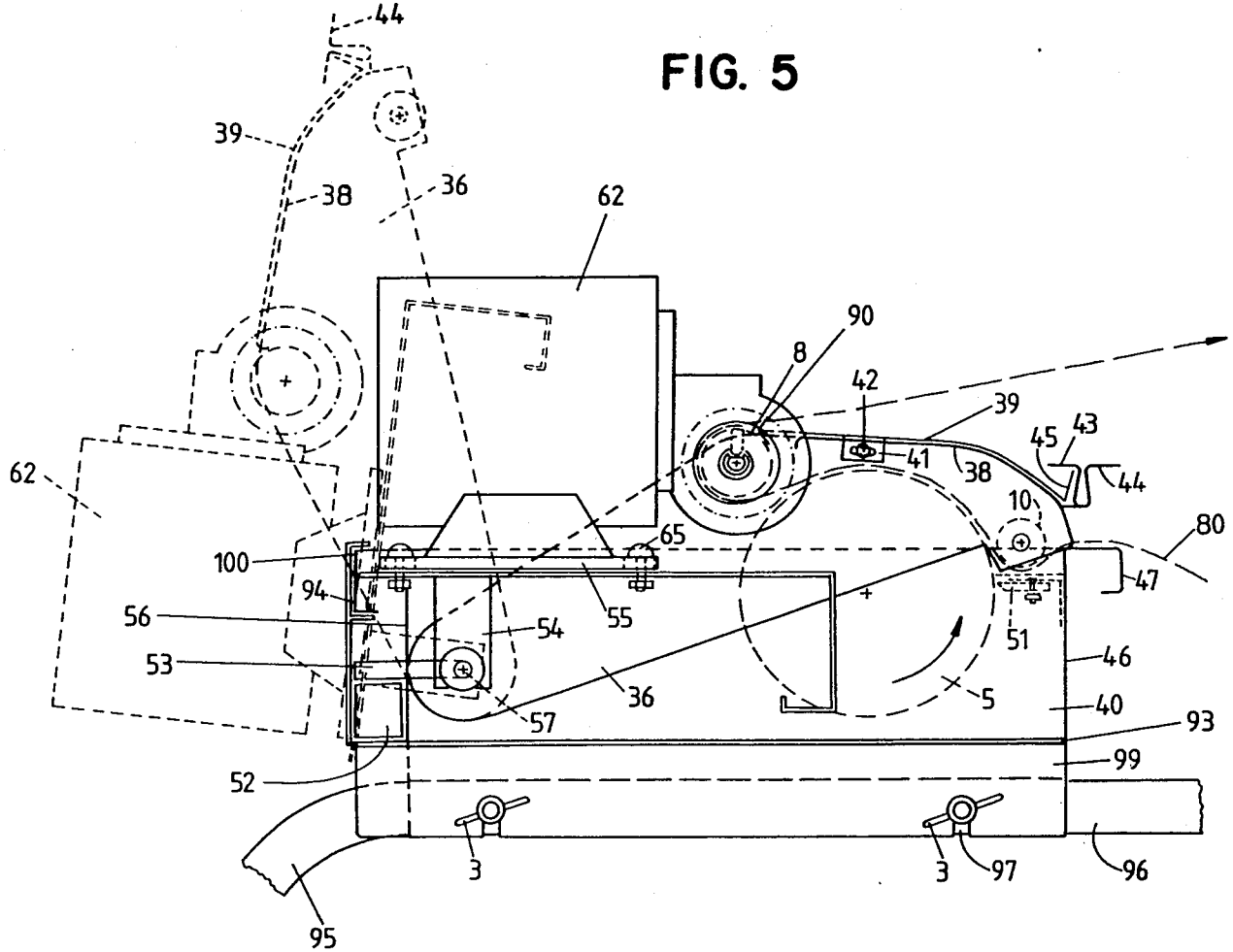
FIG. 5 is a sideview of the version of the apparatus shown in FIG. 4.

The cover 6 is made up of two side parts 36, and a cover part 38 made of sheet metal, best seen in FIG. 5, which extends over the entire width of the cover 6.

Each sidepart 36 is supported by respective stems of screws 37, which in turn are supported by respective sidewalls 40 of the container 1.

Taking into account manufacturing tolerances, an edge 109 of the cover part 38 facing the roller 8 is located a fair distance from the roller 8. To avoid the risk that an operator might lodge a finger in the gap extending between the roller 8 and the cover part 38, a cover sheet 39, best seen in FIGS. 3 and 5, extends additionally over the cover part 38. As can best be seen in FIGS. 3 and 5, the cover sheet 39 grippingly extends with two projections 41 over the side parts 36, and is secured to the side parts 36 by means of respective screws 42. An edge 90 of the cover sheet 39 is spaced at such a small distance or gap from the roller 8, so that there is no danger that a finger of an operator might be lodged in that gap.

In an alternate version of a safety feature protecting an operator from inadvertently inserting a finger into such a gap, supporting means can be provided which support the rerouting roller 8 in a substantially unyielding manner in response to a force acting along a force direction towards and approximately tangential to the glue application roller 5, but supporting the rerouting roller yieldably in response to a force acting along a direction opposite to that force direction. This version is implemented by providing two support pins, which are coaxially disposed with the axle of the rerouting roller 8, and extend outwardly on each side from the rerouting roller 8. The container 1 is, in turn, formed with two bores of a prearranged diameter which are operatively aligned coaxially with the pins, respectively, and two longitudinal grooves of a width slightly smaller than the bore diameters. The grooves communicate with the bores, respectively, extend along a longitudinal direction approximately parallel with the axle of the rerouting roller, and each have a depth along a direction approximately opposite to the force direction.

The supporting means can be implemented, for example, by a sleeve which normally has a preset diameter so as to be easily received in each bore, but which is deformable under pressure to a diameter smaller than the prearranged diameter so as to fit the width of the grooves. Each sleeve is arranged to fittingly receive a corresponding pin so that when a force acts on the sleeves in a direction opposite to the force direction, the sleeves are pressed into the grooves, respectively.

Figure 3:
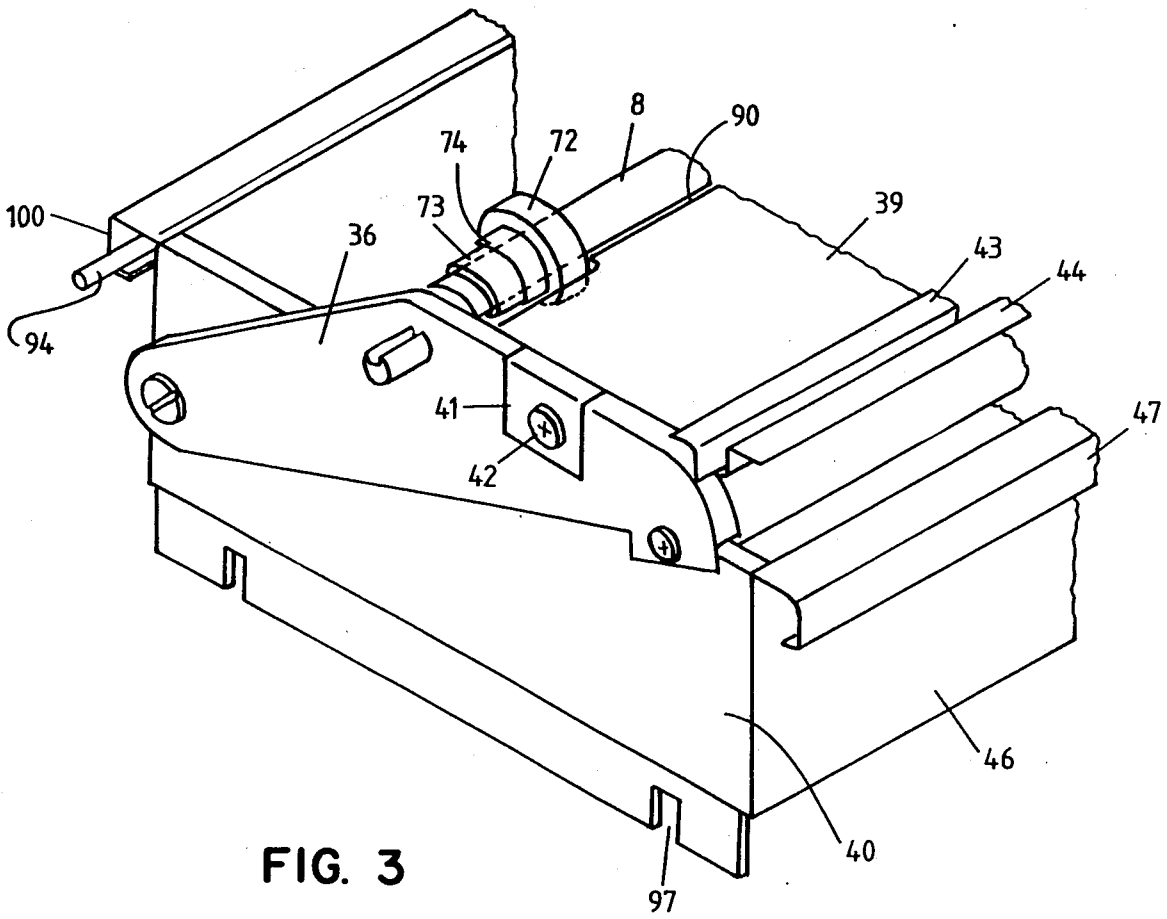
FIG. 3 is a perspective view of the portion of the apparatus on which the drive motor is normally mounted; for clarity's sake, however, the motor has been removed from FIG. 3.

As can be best seen in FIGS. 3 and 5, a first angle bracket 43 is welded to the cover part 38, and a second angle bracket 44 is in turn welded to the first angle bracket 43, so that these two angle brackets have together an approximately U-shaped cross-section, the arms of the resultant U-shaped combined bracket extending outwardly on opposite sides thereof. This combined and U-shaped bracket forms a groove, in which a cutter can be guided manually. A bent end portion 45 of the cover sheet 39 extends below the angle bracket 45.

In order to make the rear wall of the container more rigid, an upper portion 100 of the container rear wall, best seen in FIG. 5, is bent at an angle. As best seen in FIGS. 3 and 5, an iron bar 94 is point-welded to the rear wall of the container, and serves as a stop for the cover, when it is lifted and pivoted rearwardly. In FIG. 5 the cover is shown by dotted lines in the lifted position.

As best seen in FIGS. 3, 5 and 6, the front wall of the container 46 is bent over threefold along its upper portion. As can be seen in FIG. 6, an angle bracket 48 is connected, for example, by point welding, to the front wall 46, which, in turn receives screws 49; a strip-off member 50 is secured by means of the screws 49 to the angle bracket 48. The strip-off member is spaced from the outer periphery of the roller 5 by a predetermined distance; this distance determines the thickness of the layer of glue, which adheres to the roller 5. The strip-off member 50, made of sheet metal, extends over the entire width of the roller 50. A strip-off element 51 is, however, provided only for that region of the roller 5, from which glue is to be removed entirely. The strip-off member 51 is made of elastic material, preferably from a rubber block, which is cut so as to assume the shape of a wedge on the side facing the roller 5, and which abuts the roller 5 with its pointed edge.

Figure 8:
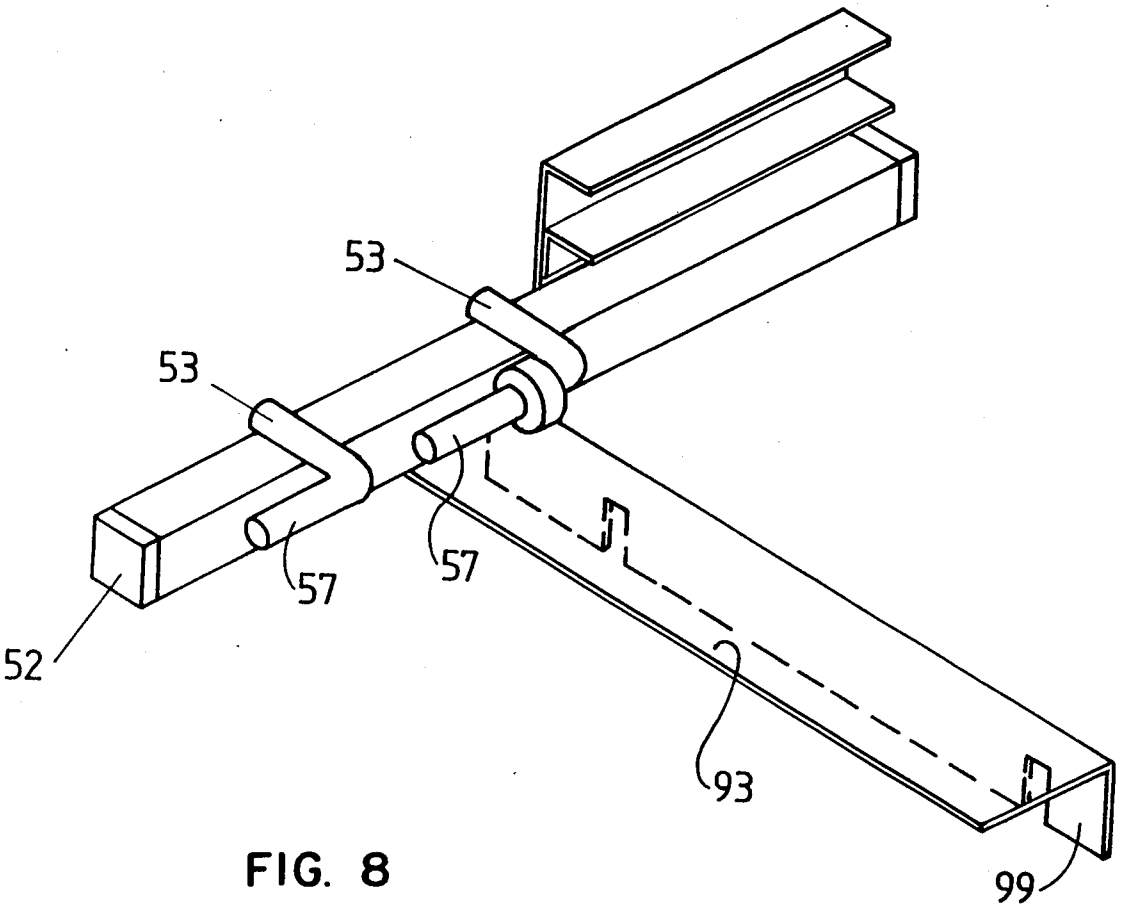
FIG. 8 is a large-scale perspective view of a detail of the motor support.

The container rests on a frame provided with four legs 95, of which only one is shown for clarity's sake in FIG. 5. Lateral strips of the container extend over respective struts 96 of the frame, and are formed with recesses 97, as best seen in FIGS. 3 and 5, through which the stems of screws 3 are allowed to pass if the container is lifted from the frame, without the wing screws 3 having to be entirely unthreaded. The screws also maintain a holder sheet 99 in place, as best seen in FIG. 5, which sheet is also formed with slits through which the screws 3 are permitted to pass. This holder sheet is, in turn, formed with an outwardly extending strip 93, best seen in FIG. 5. A four-sided tube 52 is secured, for example, by welding, to the strip or rod 93; two rods 53 of circular cross-section, are, in turn welded to the upper side of the four-sided tube 52. The rods 53 are formed with a portion 57 bent generally at right-angles to the part of the rod extending substantially horizontally, as seen in FIG. 5, or as shown in perspective, in FIG. 8. As best seen in FIG. 4, the arms of a generally U-shaped bracket 54 are pivotably supported on the rod portions 57, the rod portions 57, in turn, each carrying a sleeve 58. A wing screw 57 secures at least the outer of the sleeves 58 so as to limit any lateral displacement of the arms of the U-shaped bracket 54. The bracket 54, as can best be seen in FIGS. 4 and 5, are in turn connected to a base plate 60. The base plate 60 is formed with four slits 61 extending parallel to one another, and as seen in FIG. 5, a foot plate 55 of a motor 62 is, in turn, supported on the base plate 60. The foot plate 55, as best seen in FIG. 4, is also formed with four longitudinal slits 63, which, however, extend transversely, or at right angles to the slits 61. Screws 65 extend through respective points of intersection of the slits 61 and 63. The motor 62 can be shifted and adjusted with respect to the bracket 54 through the longitudinal slits 61 and 63, which in turn permits the drive shaft 68 to be adjusted. As can be seen in FIG. 4, the rod portions 57 are precisely lined up in a coaxial manner with respective screws 37. A worm gear 67 is in driving connection with the motor 67, the drive shaft 67 being, in turn, connected to the worm gear 67. As can be additionally seen in FIG. 4, the drive shaft 68 is also coupled through a coupling sleeve 70 by means of two screws with the shaft of the roller 8. Furthermore a friction ring 72 is disposed on the roller 8, which differs from the friction ring 12 of the embodiment shown in FIGS. 1 and 2, by being provided with a laterally projecting extension part 73, which may be clamped onto the roller 8 by means of a clamping member 74.

From FIG. 5 it can also be seen how the sheet of wallpaper 80 shown in dotted lines moves through the apparatus, according to the present invention. The sheet of wallpaper 80 is guided below the bracket 47 towards the front wall 46 so that the side thereof, upon which glue is to be applied, faces downwardly. The sheet of wall paper then passes below the roller 10, which, in turn, is supported on the side walls 36, and ensures that the sheet of wall paper abuts the roller 5 with an adequately large portion of its periphery. The roller 5, which rotates in a counterclockwise direction, is immersed with a lower portion thereof into the glue disposed in the container, and carries the glue, which adheres to its surface, therealong. The glue which adheres to the surface of the roller is transferred to the lower side of the sheet of wallpaper 80, the wall paper being thereafter guided around the roller 8 and pulled along therewith, as the roller 8 is driven, until such time as the sheet of wall paper is manually pulled off in a rightwardly upward direction, as seen in FIG. 5, upon a slight tension being exerted on the sheet of wallpaper 80. Supporting pins 4', which are secured to the sidewalls 40 by means of screws, as shown in FIG. 4, carry the roller 5.

An alternate embodiment of the inventive apparatus is shown in FIG. 7; a shaft 20 of the roller 8 is supported in lateral walls 36' of the cover 38. The electric motor 84 is flanged onto the left sidewall 36' by flanges 85 of respective struts mounted on the electric motor 84, and the flanges 85 are securely threaded on the left sidewall 36'. A shaft 87 of the electric motor is connected to a coupling member 88 with the shaft 20 of the roller 8; the coupling member 88 is connected with one end thereof to the shaft 87 through conventional coupling means, such as a simple wedge toothing, while it is connected with the other end thereof through torque limiting means, such as used, for example, in conventional torque-limiting screw spanners and the like known from German Patent Specification No. 32 29 016, or "Kupplungs-Atlas" by F. W. Lohr, AGT-Verlag Georg Thum, Germany, Ludwigsburg, 1961 page III A 1.4–1.5.1, paragraph 1.5. Hence if a finger of an operator becomes lodged between the roller 8 and the front edge 90 of the cover 38, torque transfer between the shaft 87 of the electric motor 84 and the shaft 20 of the roller 8 is interrupted.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. An apparatus adapted for applying glue to a longitudinal wallpaper being passed therethrough along a drive direction, and being withdrawn therefrom along another direction at least partly opposite to said drive direction, comprising in combination a frame adapted to hold glue therein, a glue application roller mounted on said frame, a rerouting roller in parallel with, and downstream of said application roller, as seen along said drive direction, and being spaced therefrom by a predetermined distance, and a drive motor in direct driving connection with said rerouting roller, said rerouting roller being adapted to receive and take along said wallpaper from said glue application roller only upon the wallpaper passing over at least a part of said application roller along said drive direction, being subsequently rerouted by said rerouting roller to said other direction, and upon a pull being thereafter exerted onto said wallpaper along said other direction, and whereby said wallpaper is transported along said rerouting roller upon said drive motor being switched on and upon said pull being exerted onto said wallpaper, wherein the wallpaper is not taken along by said rerouting roller in the absence of said pull.

2. The apparatus as claimed in claim 1, further comprising a axle mounted on said frame, and a cover pivotable about said axle, and wherein said motor is pivotable about an axis coaxial with said axle.

3. The apparatus as claimed in claim 2, wherein said frame includes a container, and further comprising stop means mounted on said container for limiting movement of said cover.

4. The apparatus as claimed in claim 2, wherein said motor is supported on said cover.

5. The apparatus as claimed in claim 2, wherein said rerouting roller is supported on said cover.

6. The apparatus as claimed in claim 5, further comprising a support member secured to said cover, and wherein said motor is supported on said support member.

7. The apparatus as claimed in claim 1, wherein said direct driving connection between said drive motor and said rerouting roller comprises transmission means linking said drive motor and said rerouting roller.

8. The apparatus as claimed in claim 7, wherein said drive motor includes a shaft spaced from, but coaxial with said rerouting roller, and wherein said transmission means comprises a polygonal surface formed at an end of said shaft facing said rerouting roller, and a recess formed in said rerouting roller coaxial with an axis of said rerouting roller, and defining an inner peripheral surface in said rerouting roller, whereby said drive motor shaft formed with said polygonal surface may be received in, and mate with said recess.

9. The apparatus as claimed in claim 7, wherein said drive motor and said rerouting roller each include respective shafts facing and coaxial with one another, and wherein said transmission means includes a coupling member having a central axis, and being formed with coaxial recesses on respective lateral ends thereof, the end of each shaft being formed with a polygonal peripheral surface mating with a corresponding coaxial recess.

10. The apparatus as claimed in claim 9, wherein said coupling member includes torque transmission limiting means.

11. The apparatus as claimed in claim 10, wherein said torque transmission limiting means includes a material of said coupling member arranged to be destroyed when a shearing torque above a predetermined limit is applied thereto.

12. The apparatus as claimed in claim 1, further comprising a friction drive ring mountable on said rerouting roller and operatively abutting said glue application roller.

* * * * *